United States Patent [19]

Wystemp et al.

[11] Patent Number: 4,746,280

[45] Date of Patent: May 24, 1988

[54] SLIDING VANE PUMP

[75] Inventors: Willie Wystemp; Michael F. Hughes, both of Oklahoma City, Okla.

[73] Assignee: Corken International Corporation, Oklahoma City, Okla.

[21] Appl. No.: 16,287

[22] Filed: Feb. 19, 1987

[51] Int. Cl.[4] ..... F04C 18/344

[52] U.S. Cl. ..... 418/268; 418/152

[58] Field of Search ..... 418/259, 266–270, 418/152

[56] References Cited

U.S. PATENT DOCUMENTS

| | | | |
|---|---|---|---|
| 2,499,763 | 3/1950 | Livermore | 418/268 |
| 2,541,405 | 2/1951 | Chapman | 418/266 |
| 2,545,238 | 3/1951 | MacMillin et al. | 418/268 |
| 2,982,223 | 5/1961 | Rosaen | 418/112 |
| 3,072,066 | 1/1963 | Kennedy et al. | 418/83 |
| 3,086,475 | 4/1963 | Rosaen | 418/268 |
| 3,102,494 | 9/1963 | Adams | 418/268 |
| 3,211,104 | 10/1965 | Rosaen | 418/268 |
| 3,213,803 | 10/1965 | Meyer | 418/152 |
| 3,627,456 | 12/1971 | Gerlach | 418/268 |
| 3,711,227 | 1/1973 | Schmitz | 418/268 |
| 3,790,314 | 2/1974 | Swain et al. | 418/1 |
| 3,869,231 | 3/1975 | Adams | 418/167 |
| 4,242,068 | 12/1980 | Shaw | 418/269 |
| 4,355,965 | 10/1982 | Lowther | 418/111 |
| 4,392,795 | 7/1983 | Smith | 418/31 |
| 4,521,167 | 6/1985 | Cavalleri et al. | 418/82 |

OTHER PUBLICATIONS

Blackmer Pump Company Spec Sheet 76.

Corken International Corporation Service Manual, pp. C1008–C1009.

Corken International Corporation Service Manual, pp. C140J, 141J, 146E, 147E.

*Primary Examiner*—Carlton R. Croyle

*Assistant Examiner*—Jane E. Obee

*Attorney, Agent, or Firm*—Laney, Dougherty, Hessin & Beavers

[57] ABSTRACT

A sliding vane pump having a hydraulic vane actuation system. The pump includes a case with a liner having an eccentric surface therein. A rotor and shaft rotate within the liner. The rotor has a plurality of radial slots therein, with a vane slidably disposed in each of the slots. Each vane has a radially inner edge with first and second sides extending substantially normally therefrom. A radially outer edge extends normally from the first side and is opposite and substantially parallel to the radially inner edge. A beveled edge extends radially inwardly from the outer edge and interconnects the outer edge with the second side. As the rotor rotates, the beveled edge is the leading edge of the vane. A plurality of radially oriented holes are defined through each vane. The holes intersect the inner edge and a portion of the beveled edge and a portion of the outer edge. Fluid travels radially inwardly and outwardly through the holes in the vanes as the rotor rotates, providing hydraulic actuation of the vanes outwardly, as well as providing fluid relief therefor.

21 Claims, 2 Drawing Sheets

SLIDING VANE PUMP

BACKGROUND OF THE INVENTION

1. Field of the Invention

This invention relates to sliding vane positive displacement pumps, and more particularly, to such pumps having hydraulically actuated vanes.

2. Description of the Prior Art

One of the primary concerns in using positive displacement pumps of the sliding vane type is maintaining the vanes in contact with the inner surface of a liner along which the vanes ideally move in transporting liquids through the pump. As is known to those skilled in the art, there is a natural centrifugal force acting outwardly on the vanes as the rotor rotates. However, in most applications involving liquids, the vanes will move radially inwardly away from the inner surface at certain points and thus fluid will slip by the vanes. The result is a decrease in pumping efficiency. Many means have been devised to place additional outwardly acting forces on the vanes in addition to the centrifugal force so that the vanes will track the inner surface of the liner properly for maintaining higher pumping efficiency.

In many cases, holes are drilled through the rotor and shaft interconnecting opposite pairs of slots in the rotor. Pins or other actuators are then slidingly positioned in the holes such that as one vane moves inwardly, the opposite vane is forced outwardly. One problem with such systems is that the dimension across the liner may not be constant. If this is the case, the pin must be somewhat shorter than the normal distance between the two innermost edges of the opposite vanes. Even if the distance across the liner is constant, the solid pin arrangement allows no compensation for wear on the outer edges of the vanes or wear by the contact of the vanes by the pin. In either case, the result is that the pin has some movement between the vanes and is not maintained in constant contact with the inner edges thereof. The pin is thus bounced back and forth between the vanes as the rotor turns. In other words, the pin impacts the inner surface of each of the opposite vanes for each revolution of the rotor. At the high speeds with which positive displacement pumps may be operated, the force of impact of the pin on the vanes can be quite high, quickly resulting in damage to the vanes. One solution has been the use of hard metal bumpers attached to, or molded into, the vanes to protect the inner surface. The result is an expensive vane, and the pins will eventually wear the bumpers as well.

Another method of providing outward force on vanes for sliding vane pumps is the use of a coil spring positioned between the inner surface of the vane and the rotor slot. One such arrangement is shown in U.S. Pat. No. 2,541,405 to Chapman, in which a hole is countersunk in each vane to contain and guide the spring. There are many variations on the spring actuated vane arrangement. The system has the advantage of compensating for wear on the outer surface of the vanes, but a frequent problem is wear on the outer surfaces of the spring.

Another solution along similar lines has been the use of two pins disposed in a hole intercommunicating opposite slots with a spring positioned therebetween to help absorb shock and compensate for wear. This arrangement contains the spring sufficiently so that it will not skew, but still has the disadvantage of wear on the outer surface of the spring because the spring must slide in the hole in the rotor.

All of these mechanically actuated vanes work with varying degrees of success, at least when the fluid being pumped provides some lubrication for the various moving components. However, mechanical actuation has been shown to be particularly unsatisfactory in cases where low viscosity fluids such as propane, anhydrous ammonia, and other light hydrocarbons are being pumped. Because such fluids provide virtually no lubrication, mechanical actuation systems wear quite rapidly, resulting in undesirably short service life.

In an effort to eliminate the problems of mechanical actuation systems, hydraulic vane actuation systems have been developed. Such a pump is disclosed in U.S. Pat. No. 3,072,066 to Kennedy, et al., assigned to the assignee of the present invention. In this pump, a channel in a sideplate adjacent the rotor directs fluid beneath the vanes to provide hydraulic force to move the vanes radially outwardly. A variation on such a system, but not disclosed in Kennedy et al., includes holes drilled in the rotor which direct fluid beneath the vanes.

These hydraulic vane actuating systems have proved successful for many years in the pumping of low viscosity fluids. However, even with such systems, the actuation of the vanes may become erratic under certain conditions such that the vane will not properly track along the liner and the pump will correspondingly lose efficiency. The vane used in the pump of the present invention includes flow passageways in the vane itself which direct fluid from the leading edge of the vane to the radially inner edge to assist in forcing the vane outwardly to the liner adjacent the pump inlet. The passageways through the vanes intersect the radially outer edge and a beveled leading edge which faces generally in the direction of rotation of the rotor. Further, the passageways provide fluid relief as the vanes are forced inwardly by the liner adjacent the pump outlet.

U.S. Pat. No. 2,982,223 to Rosaen discloses a vane with a beveled outer edge which generally faces in the direction of rotation. The vane has a passage which opens to the forward side of the vane. U.S. Pat. No. 4,521,167 to Cavalleri, et al. shows a vane with a somewhat tapered leading outer edge with radial slots in the leading side of the vane. Neither of these vanes has a distinct radially outer edge. Instead, they have rounded corners contacting the inner surface of the liner as the rotor rotates. In the vane of the present invention, a distinct outer edge is provided, and the passageways through the vane intersect this edge as well as the beveled leading edge. Testing has shown that intersection of the passageways with both the leading and outer edges apparently helps prevent detrimental effects of the fluid boundary along the inner surface of the liner as the outer edge of the vane travels thereacross.

In addition to eliminating the problems associated with mechanical vane actuating systems, the hydraulic vane actuating system of the pump of the present invention also eliminates problems with previous hydraulic actuation systems. Thus, the pump and vane of the present invention particularly provide a better system for use with low viscosity fluids, representing a distinct improvement over the prior art.

SUMMARY OF THE INVENTION

The sliding vane pump of the present invention comprises a housing or case defining a longitudinal axis therethrough and having an inlet and an outlet therein, a liner having a cam-shaped inner surface eccentrically disposed within the housing, a rotor having a plurality of substantially radially disposed slots therein and further having a pair of parallel ends, a substantially flat sideplate disposed adjacent each of the ends of the rotor, and a plurality of vanes slidably disposed in the slots in the rotor. The rotor is disposed concentric with the housing and rotatable about the longitudinal axis thereof. The rotor has an outside diametric surface in close, spaced relationship to a portion of the inner surface of the liner.

Each of the vanes used in the pump comprises a first edge adapted to be a radially inner edge when the vane is in an operating position in the pump, first and second sides extending from the first edge, a second edge adapted to be a radially outer edge when the vane is in the operating position and which is spaced from the first edge and extends from the first side, a face portion extending inwardly with respect to the second edge and interconnecting the second edge and second side, and passageway means extending from the first edge and intersecting a portion of the second edge and a portion of the face portion. The first and second sides are preferably planar and substantially parallel to one another. Similarly, the first and second edges are preferably planar and substantially parallel to one another. Also in the preferred embodiment, the first and second edges extend normally from the first side.

The face portion is preferably characterized by an angled third edge or beveled surface. The third edge preferably extends from the second edge at an angle of approximately 60°. The third edge is also preferably substantially planar.

In the preferred embodiment, the flow passageway means comprises a plurality of substantially parallel, radially oriented passageways or holes defined through the vane. These holes are substantially equally spaced along the longitudinal length of the vane and are substantially cylindrical in configuration. In one embodiment, the holes are centered between the first and second sides of the vane. In an alternate embodiment, the holes are disposed nearer the second side of the vane than the first side so that the width of the first, outer edge is maximized.

Each of the vanes is of one-piece molded construction. The material used is preferably a plastic which is chemically compatible with the fluid being pumped.

An important object of the present invention is to provide a sliding vane pump with a hydraulic vane actuating system.

Another object of the invention is to provide a vane actuating system for a pump for use with fluids of relatively low viscosity.

A further object of the invention is to provide a vane having a beveled leading edge and flow passageways through the vane for directing fluid behind the vane for hydraulic actuation thereof.

Still another object of the invention is to provide a hydraulically actuated vane having fluid holes therethrough which intersect a radially outer edge and a beveled leading edge of the vane.

Additional objects and advantages of the invention will become apparent as the following detailed description of the preferred embodiment is read in conjunction with the accompanying drawings which illustrate such preferred embodiment.

DETAILED DESCRIPTION OF THE PREFERRED EMBODIMENT

Figure 1:
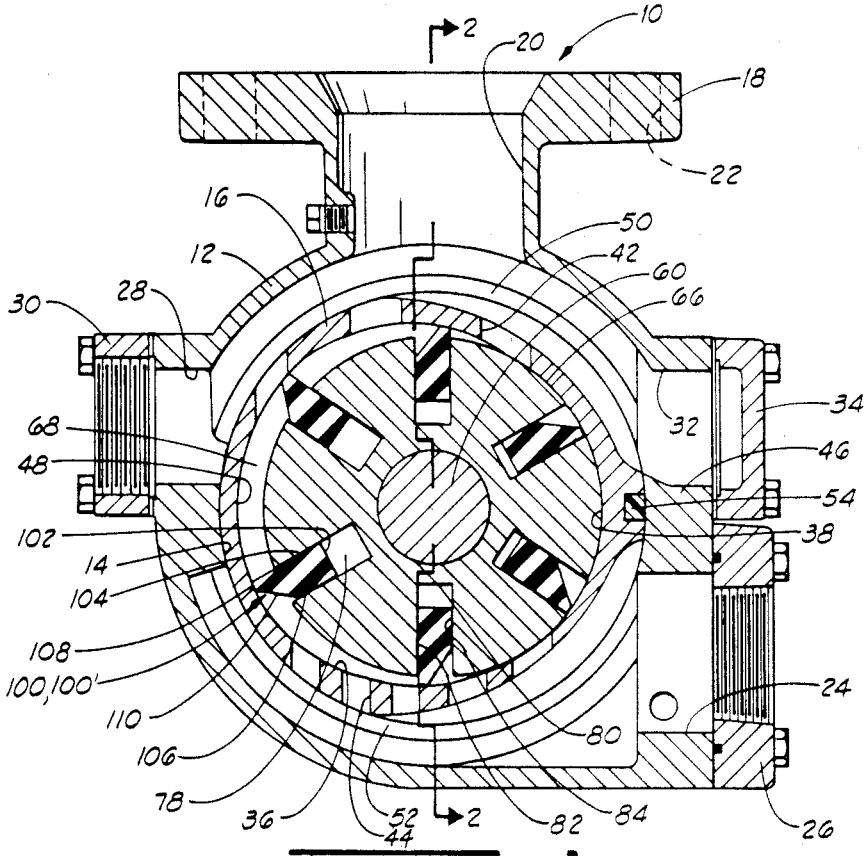
FIG. 1 shows a cross-sectional view of a sliding vane pump of the present invention taken perpendicular to the longitudinal axis of rotation as indicated by lines 1—1 in FIG. 2.
Figure 2:
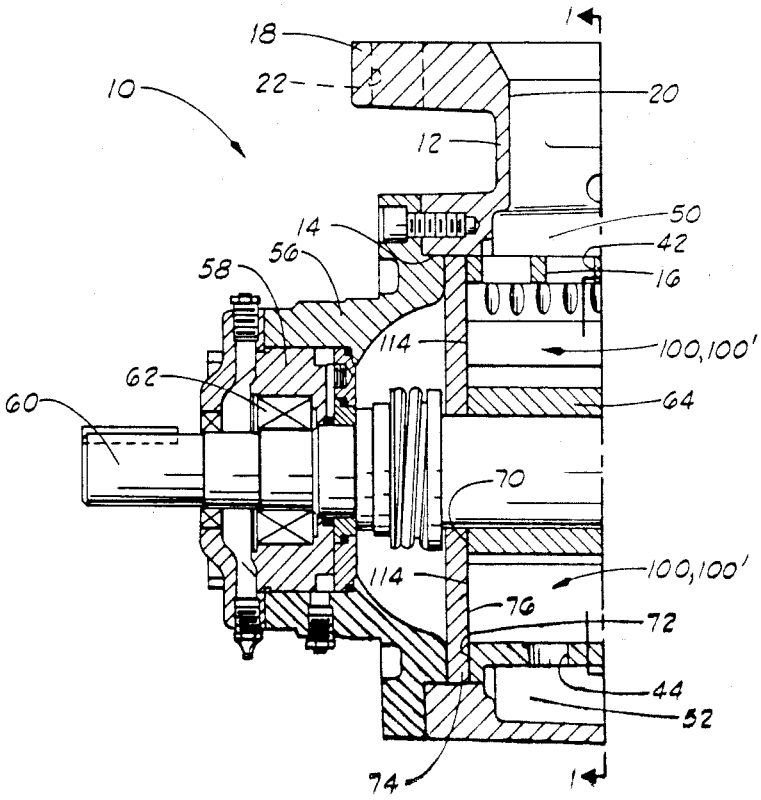
FIG. 2 shows a partial longitudinal cross section taken along lines 2—2 in FIG. 1.

Referring now to the drawings, and more particularly to FIGS. 1 and 2, the sliding vane pump of the present invention is shown and generally designated by the numeral 10. Pump 10 includes an outer housing or case 12 defining a substantially circular inside diameter 14 with a longitudinal axis therethrough. A liner 16 is positioned in inside diameter 14 of case 12. In the embodiment shown in the drawings, liner 16 is separable from case 12, but in an alternate embodiment, the liner could be integral with the case.

As illustrated in the drawings, case 12 has a large inlet flange 18 defining an inlet opening 20 therethrough in communication with the interior of case 12. Inlet flange 18 is an ASA-type flange with a plurality of mounting holes 22 therethrough for mounting to a mating flange (not shown) on a fluid tank, such as is frequently found on propane delivery trucks.

Case 12 also has an outlet 24 with an outlet flange 26 attached adjacent thereto. Included in case 12 are an auxiliary inlet 28 having an auxiliary inlet flange 30 attached adjacent thereto and another auxiliary inlet 32 closed by a blind flange 34.

The specific embodiment of case 12 disclosed herein is for illustrative purposes only, and the invention is not intended to be limited to such a configuration. The location and size of the inlet, auxiliary inlets, and outlet, as well as the size and configuration of the various flanges may vary as desired for any particular pumping situation.

Liner 16 defines a cam-shaped inner surface 36 eccentric with respect to inside diameter 14 of case 12. Thus, cam-shaped inner surface 36 of liner 16 has a minimum radius defining a stop portion 38 and a maximum radius portion 40. Liner 16 further defines a plurality of inlet ports 42 and a plurality of outlet ports 44 therein.

Case 12 includes a first liner support 46 and a second liner support 48 generally opposite first liner support 46. Liner supports 46 and 48 extend the full longitudinal width of liner 16. Thus, an inlet chamber 50 and a separate outlet chamber 52 are defined by case 12 and liner 16. It will be seen by those skilled in the art that there is no communication between inlet chamber 50 and outlet chamber 52 around the outside of liner 16. Liner 16 is maintained in position by a key 54 attached to first liner support 46 of case 12.

As shown in FIG. 2, a pair of heads 56 are mounted to case 12 on opposite sides thereof. Each head 56 carries a bearing housing 58 concentric with inside diameter 14 of case 12. A shaft 60 extends through pump 10 along the longitudinal axis of case 12. Shaft 60 is supported by a bearing 62 positioned in each bearing housing 58 for rotation within pump 10.

Referring again also to FIG. 1, a rotor 64 is fixedly attached to shaft 60 and rotatable therewith. Rotor 64 defines a substantially circular outside diameter 66. Outside diameter 66 is in close, spaced relationship to stop portion 38 of cam-shaped inner surface 36 of liner 16. Further, it can be seen that outside diameter 66 is spaced away from maximum radius portion 40 of liner 16 so that a pumping chamber 68 is defined therebetween.

As seen in FIG. 2, rotor 64 has a pair of longitudinally outer ends 70. A disc-shaped sideplate 74 is disposed between substantially flat surface 76 which is positioned adjacent outer end 70 of rotor 64 and against outer end 72 of liner 16. Ends 70 of rotor 64 are spaced slightly away from sideplates 74, and sideplate 74 limits longitudinal movement of rotor 64 and shaft 60.

Referring again to FIG. 1, rotor 64 defines a plurality of substantially equally radially oriented slots 78 therein which are preferably equally angularly spaced around the rotor. The number of slots may vary as desired, and the invention is not intended to be limited to the six-slot configuration illustrated. Each slot 78 has a radially inner surface 80, a first radial side 82 and a second radial side 84. Preferably, first and second radial sides 82 and 84 are parallel to one another and extend normally from inner surface 80. In the view shown in FIG. 1, rotor 64 and shaft 60 rotate in a counterclockwise direction with respect to case 12 and liner 16. Thus, second radial side 84 of each slot 78 is the leading side of the slot.

Figure 3:
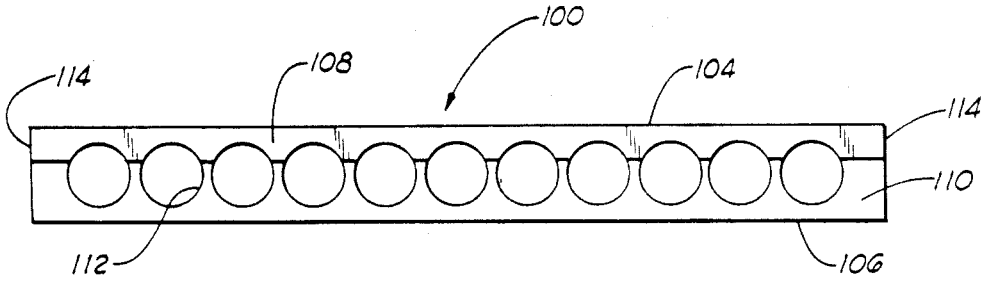
FIG. 3 is a view of a first embodiment of the vane used in the sliding vane pump of the present invention as seen from the radially outer edge of the vane.
Figure 4:
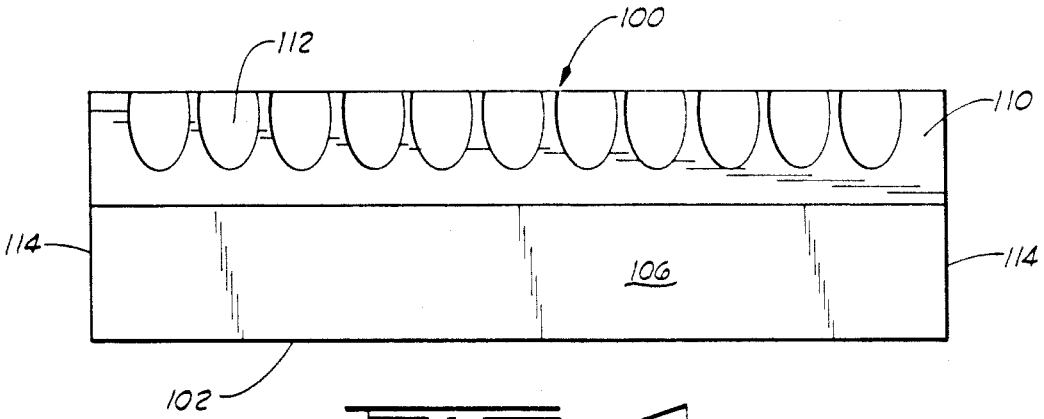
FIG. 4 shows a leading side view of the vane illustrated in FIG. 3.
Figure 5:
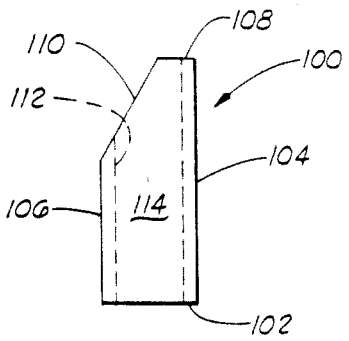
FIG. 5 illustrates an end view of the vane in FIG. 3.

Slidably disposed in each slot 78 is a blade or vane, a first embodiment of which is identified by numeral 100. Referring now also to FIGS. 3–5, details of vanes 100 will be discussed. Each vane 100 is preferably a one-piece member molded of a material such as plastic. A radially inner, first edge 102 of vane 100 generally faces toward inner surface 80 of slot 78. First edge 102 is preferably planar. Extending from inner edge 102 is a first, substantially planar side 104 and a second, substantially planar side 106. Preferably, first and second sides 104 and 106 are parallel to one another and normal to inner edge 102. It will be seen that first side 104 of vane 100 is adapted for sliding engagement with first side 82 of slot 78, and second side 106 of vane 100 is adapted for sliding engagement with second side 84 of slot 78.

A radially outer, second edge 108 extends from first side 104 opposite inner edge 102. Preferably, outer edge 108 is planar and extends substantially normally from first side 104, and thus is substantially parallel to inner edge 102. A beveled face portion or third edge 110 extends radially inwardly with respect to outer edge 108 and interconnects outer edge 108 with second side 106. Preferably, beveled edge 110 is substantially planar and extends at an angle of approximately 60° from outer edge 108.

A plurality of fluid passageways or holes 112 extend radially through each vane 100. Preferably, holes 112 are equally spaced along the longitudinal length of vane 100. Holes 112 intersect inner edge 102 and also intersect a portion of beveled edge 110 and outer edge 108. In the first embodiment, holes 112 are transversely centered between first side 104 and second side 106 to maximize the strength of vane 100. Holes 112 are preferably cylindrical, and the size and number thereof may vary as desired.

Finally, each vane 100 has a pair of opposite longitudinal ends 114 which are preferably parallel with one another and normal to the other surfaces of the vane. As seen in FIG. 2, outer ends 114 of vanes 100 are in close, spaced relationship to flat surfaces 76 of sideplates 74. Thus, sideplates 74 limit longitudinal movement of vanes 100.

Figure 6:
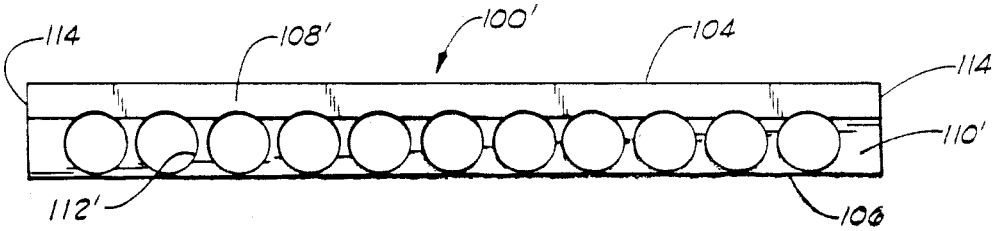
FIG. 6 is a view from the radially outer edge of an alternate vane embodiment.

Referring now to FIG. 6, an alternate embodiment of the blade or vane is shown and identified by numeral 100'. The general shape of vane 100' is essentially identical to that of first embodiment vane 100. However, in vane 100', passageways or holes 112' therethrough are positioned closer to second side 106 than to first side 104 of the vane. In this way, the width of outer edge 108' is maximized for providing more sealing surface adjacent the inner surface of liner 16 in pump 10. The actual transverse positioning of holes 112' may vary as desired so long as holes 112' intersect both outer edge 108' and beveled edge 110'. Vanes 100' are installed in pump 10 in exactly the same manner as vanes 100.

OPERATION OF THE INVENTION

In operation, fluid enters pump 10 through inlet opening 20 into inlet chamber 50. Fluid then passes through inlet ports 42 in liner 16 to be trapped between rotor 64, liner 16 and adjacent either vanes 100 or 100' depending on which vane embodiment is used. As shown in FIG. 1, rotor 64 rotates counterclockwise so that the fluid is moved through pumping chamber 68 and forced through outlet ports 44 in liner 16 into outlet chamber 52 for discharge from pump 10 through outlet 24. The close proximity of outside diameter 66 of rotor 64 and stop portion 38 of liner 16 allows comparatively little fluid to pass therebetween.

Vanes 100 or 100' are oriented so that beveled edge 110 or 110', respectively, is a leading edge of the vane. As rotor 64 turns, vanes 100 or 100' move along cam-shaped inner surface 36 of liner 16. As vanes 100 or 100' move from pumping chamber 68 to stop portion 38 adjacent outlet ports 44 in the liner, the vanes are forced inwardly. It will be obvious to those skilled in the art that as vanes 100 or 100' move from stop portion 38 to pumping chamber 68 adjacent inlet ports 30 in liner 16, the vanes must move outwardly for effective pumping. Ideally, radially outer edge 108 or 108' of each vane 100 or 100' is maintained in contact with inner surface 36 of liner 16. If any vane 100 or 100' prematurely moves radially inwardly away from liner 16, fluid will be allowed to pass thereby, thus reducing the efficiency of pump 10.

The configuration of vanes 100 or 100' provides hydraulic actuation of the vanes so that the vanes are always forced radially outwardly towards inner surface 36 of liner 16. As vanes 100 or 100' move radially outwardly in slots 78, fluid will contact leading, beveled edge 110 or 110' and flow radially inwardly through holes 112 or 112' into the volume between the vane and inner surface 80 of slot 78. This variable volume may be described as a bottom portion of slot 78. Thus, fluid pressure acting on beveled edge 110 or 110' is transferred through holes 112 or 112' to act on inner edge 102 of vanes 100 or 100'. Holes 112 or 112' thus provide a fluid passageway means through vanes 100 or 100'. This fluid pressure helps keep vanes 100 or 100' pushed radially outwardly toward liner 16.

As vanes 100 or 100' are forced radially inwardly by liner 16 as they pass adjacent outlet ports 44 in the liner, holes 112 or 112' act as a fluid relief passageway means so that fluid is not trapped in the volume between vane 100 or 100' and the bottom of slot 78. This is necessary because liquids are substantially incompressible and must be relieved from behind the vanes or there is a likelihood of damage to the pump. Even if there is no damage, at the least the power required to operate pump 10 will be increased.

Tests have shown the configuration of vanes 100 or 100' to be quite effective, particularly in pumping fluids having low viscosities and low specific gravities, such as propane, butane, anhydrous ammonia, and other light hydrocarbons. For vane 100, it is important that holes 112 intersect not only leading, beveled edge 110 but also radially outer edge 108. Similarly, holes 112' must intersect not only leading, beveled edge 110' but also radially outer edge 108' of vane 100'. It is theorized that this configuration helps eliminate fluid boundary problems adjacent inner surface 36 of liner 16 as vanes 100 or 100' pass therealong and thus helps provide the desired fluid movement through holes 112 or 112'.

As already indicated, positioning holes 112' in alternate vane embodiment 100' closer to second side 106 than first side 104 of vane 100' maximizes the width of outer edge 108'. By maximizing the width of outer edge 108', the contact area of vane 100' with inner surface 36 of cam 16 is increased. This helps reduce the possibility of slippage of fluid by vanes 100', which of course increases pumping efficiency, in marginal pumping situations.

It will be seen that, even as radially outer edge 108 or 108' wears during operation, holes 112 or 112' will always intersect the outer edge. Also, as the vane wears, second side 106 and first side 104 will still act to keep the vane aligned properly in slot 78. Flow through holes 112 or 112' is maintained as is the desired hydraulic actuation of vanes 100 or 100'.

The design of pump 10 and of vanes 100 or 100' used therein thus offers an improvement over the prior art and provides a hydraulic vane actuating system which is particularly adapted for use with low viscosity and low specific gravity fluids.

It can be seen, therefore, that the sliding vane pump of the present invention is well adapted to carry out the objects and atain the ends and advantages mentioned, as well as those inherent therein. While a presently preferred embodiment of the invention has been described for the purposes of this disclosure, numerous changes in the construction and arrangement of the parts may be made by those skilled in the art. All such changes are encompassed within the scope and spirit of this invention as defined by the appended claims.

What is claimed is:

1. A vane for use in a sliding vane pump, said vane comprising:

a first edge adapted to be a radially inner edge when said vane is in an operating position in said pump;

first and second sides extending from said first edge;

a second edge adapted to be a radially outer edge when said vane is in said operating position, said second edge being spaced from said first edge and extending from said first side;

a face portion extending inwardly with respect to said second edge and interconnecting said second edge and said second side; and passageway means extending from said first edge and intersecting a portion of said second edge and a portion of said face portion.

2. The vane of claim 1 wherein said first and second sides are substantially parallel.

3. The vane of claim 1 wherein said first and second edges are substantially parallel.

4. The vane of claim 1 wherein said vane is of one-piece plastic molded construction.

5. The vane of claim 1 wherein said passageway means comprises a plurality of substantially parallel, radially oriented holes defined through said vane.

6. The vane of claim 5 wherein said holes are nearer said second side than said first side.

7. The vane of claim 5 wherein said holes are substantially cylindrical.

8. The vane of claim 1 wherein said face portion is characterized by an angled third edge.

9. The vane of claim 8 wherein said third edge extends from said second edge at an angle of approximately 60°.

10. The vane of claim 8 wherein said third edge is substantially planar.

11. In a pump of the type having a case, a rotor concentric with said case and rotatable therein, said rotor defining a plurality of radially extending slots with a vane slidably disposed in each slot, the improvement wherein each of said vanes comprises:

a radially inner edge;

a radially extending first side and second side;

a radially outer edge opposite said inner edge extending substantially normally from said first side; and a beveled edge interconnecting said outer edge and said second side;

wherein, said vane defines a plurality of substantially radially oriented flow passageways therethrough, said passageways intersecting said inner edge and further intersecting a portion of said outer edge and a portion of said beveled edge.

12. The pump of claim 11 wherein said flow passageways are disposed closer to said second side than said first side.

13. The pump of claim 11 wherein said fluid flow passageways comprise a plurality of substantially equally spaced cylindrical holes.

14. The pump of claim 11 wherein said beveled edge extends from said outer edge at an angle of approximately 60°.

15. The pump of claim 11 wherein said first and second sides are substantially parallel.

16. The pump of claim 11 wherein said first and second edges are substantially parallel.

17. A pump comprising:

a housing defining a longitudinal axis therethrough and having an inlet and an outlet;

a liner having a cam-shaped inner surface eccentrically disposed within said housing;

a rotor having a plurality of substantially radially disposed slots therein, said rotor being concentric with said housing and rotatable about said longitudinal axis thereof, having an outside diametric surface in close, spaced relationship to a portion of said inner surface of said liner, and further having a pair of opposite, parallel ends;

a substantially flat sideplate disposed adjacent each of said ends of said rotor; and a plurality of vanes slidably disposed in said slots in said rotor, each of said vanes comprising:

a radially inner surface;

substantially parallel first and second sides extending from said inner edge and adapted for sliding engagement with radial sides of said slots in said rotor;

a radially outer edge extending substantially normally from said first side and adapted for engagement with, and movement along, said inner surface of said liner;

a beveled surface extending radially inwardly from said outer edge and interconnecting said outer edge and said second side; wherein:

each of said vanes is disposed in one of slots such that the second side and beveled surface thereof generally face in a direction of rotation of said rotor; and each of said vanes defines a plurality of radially oriented holes therethrough, said holes intersecting at least a portion of the beveled surface and at least a portion of the outer edge such that, as said rotor rotates within said housing and said vanes pass a portion of said liner adjacent said inlet, fluid is forced radially inwardly through said holes to a bottom portion of said slots for providing fluid pressure and a radially outward force on said inner edges of said vanes for maintaining said outer edges thereof in contact with said cam-shaped inner surface face, and as said vanes pass a portion of said liner adjacent said outlet, fluid is forced radially outwardly through said holes from said bottom portion of said slots.

18. The pump of claim 17 wherein said holes in each of said vanes are closer to said second side thereof than said first side.

19. The pump of claim 17 wherein said holes are substantially equally spaced along each of said vanes.

20. The pump of claim 17 wherein said holes are of substantially cylindrical configuration.

21. The pump of claim 17 wherein said vanes further comprise a pair of opposite, substantially flat ends which are in close, spaced relationship to said sideplates.

* * * * *

UNITED STATES PATENT AND TRADEMARK OFFICE

CERTIFICATE OF CORRECTION

PATENT NO. : 4,746,280

DATED : May 24, 1988

INVENTOR(S) : Willie Wystemp and Michael F. Hughes

It is certified that error appears in the above-identified patent and that said Letters Patent is hereby corrected as shown below:

Column 5, line 15, after "between" insert --each head 56 and rotor 64 and liner 16. Sideplate 74 has a--.

Column 10, line 5, delete "face".

Signed and Sealed this

Twentieth Day of September, 1988

*Attest:*

DONALD J. QUIGG

*Attesting Officer*

*Commissioner of Patents and Trademarks*